US009980319B2

(12) United States Patent
Bach et al.

(10) Patent No.: US 9,980,319 B2
(45) Date of Patent: May 22, 2018

(54) METHOD FOR OPERATING A PLANT HAVING AT LEAST ONE OPEN- AND/OR CLOSED-LOOP HEATING CONTROL DEVICE, OPEN- AND/OR CLOSED-LOOP HEATING CONTROL DEVICE, AND PLANT

(71) Applicant: SIEMENS AKTIENGESELLSCHAFT, Munich (DE)

(72) Inventors: Christine Bach, Nuremberg (DE); Klaus Indefrey, Nuremberg (DE); Bernhard Schmidt, Nuremberg (DE); Reinhard Schneider, Bamberg (DE); Juergen Stoll, Fuerth (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 406 days.

(21) Appl. No.: 14/635,283

(22) Filed: Mar. 2, 2015

(65) Prior Publication Data

US 2015/0250023 A1 Sep. 3, 2015

(30) Foreign Application Priority Data

Feb. 28, 2014 (DE) ..... 10 2014 203 667

(51) Int. Cl.
*H05B 1/02* (2006.01)
*H05B 3/02* (2006.01)

(52) U.S. Cl.
CPC ..... *H05B 1/02* (2013.01); *H05B 1/023* (2013.01); *H05B 3/02* (2013.01)

(58) Field of Classification Search
CPC . H05B 1/02; H05B 1/023; H05B 3/02; H05B 3/0038

(Continued)

(56) References Cited

U.S. PATENT DOCUMENTS 5,023,430 A * 6/1991 Brekkestran ..... A41D 13/0051 2/69
5,053,604 A * 10/1991 Escaravage ..... C03B 29/06 219/483

(Continued)

FOREIGN PATENT DOCUMENTS

DE 19529313 2/1997
DE 202013003006 4/2013

(Continued)

OTHER PUBLICATIONS

Extended European Search Report dated Nov. 23, 2015 in corresponding European Patent Application No. 15154354.3.

(Continued)

*Primary Examiner* — Mark Paschall
(74) *Attorney, Agent, or Firm* — Henry M. Feiereisen LLC

(57) ABSTRACT

For operating a plant having at least one open- and/or closed-loop heating control device for heating elements, values for an energy consumption and/or an instantaneous power draw of the heating elements are determined, without using measured values for electric currents, on the basis of characteristic parameters of the heating elements and on the basis of values of open- and/or closed-loop control variables for the open- and/or closed-loop control of a heat output of the heating elements. This enables the network load to be determined, reported and optimized by the open- and/or closed-loop heating control devices even without complex and therefore expensive measuring devices in the open- and/or closed-loop heating control device.

17 Claims, 1 Drawing Sheet

(58) Field of Classification Search
USPC ..... 219/490, 483–487, 497, 506
See application file for complete search history.

(56) References Cited

U.S. PATENT DOCUMENTS

| | | | | |
|---|---|---|---|---|
| 5,280,434 | A * | 1/1994 | Ekendahl | B29C 51/422 340/588 |
| 8,378,272 | B2 * | 2/2013 | Shigetomi | H01L 21/67109 118/725 |
| 8,525,083 | B2 * | 9/2013 | Broniak | F24D 19/1063 219/412 |
| 9,291,528 | B2 * | 3/2016 | Galindo Perez | A47L 15/0047 |

FOREIGN PATENT DOCUMENTS

| | | |
|---|---|---|
| DE | 10 2014 203 667.4 | 2/2014 |
| EP | 0 408 472 A1 | 1/1991 |

OTHER PUBLICATIONS

Schnell Gerhard et al: "Bussysteme in der Automatisierungs- und Prozesstechnik", XP055384970, ISBN: 978-3-8343-0045-9 pp. 1-139, DOI: 10.1007/978-3-8348-9108-2; 2006.

* cited by examiner

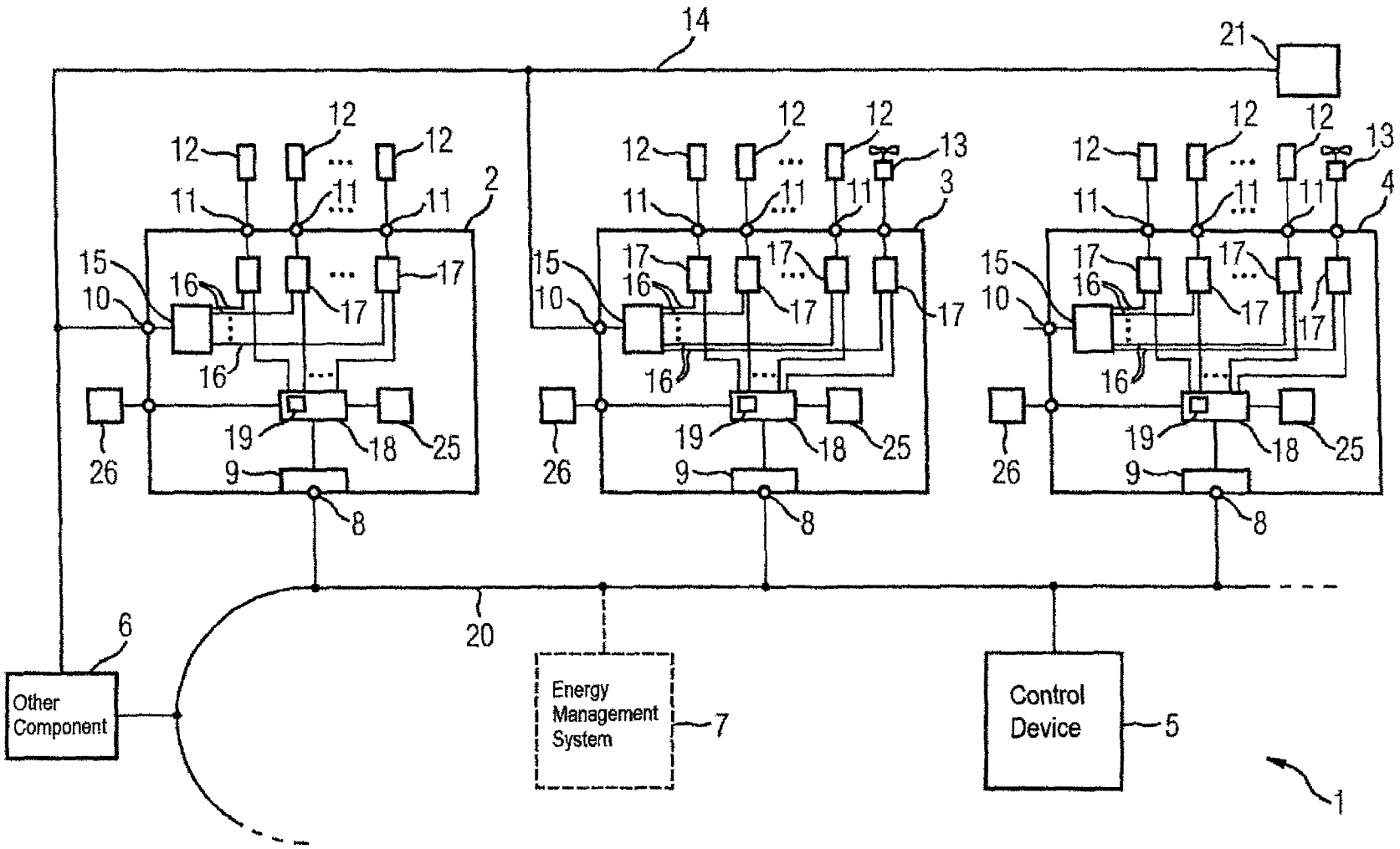
Control Device
Energy Management System
Other Component

METHOD FOR OPERATING A PLANT HAVING AT LEAST ONE OPEN- AND/OR CLOSED-LOOP HEATING CONTROL DEVICE, OPEN- AND/OR CLOSED-LOOP HEATING CONTROL DEVICE, AND PLANT

CROSS REFERENCE TO RELATED APPLICATIONS

This application is based on and hereby claims priority to German Application No. 10 2014 203 667.4 filed on Feb. 28, 2014, the contents of which are hereby incorporated by reference.

BACKGROUND

The invention relates to a method for operating a plant having at least one open- and/or closed-loop heating control device, an open- and/or closed-loop heating control device, and a plant having an open- and/or closed-loop heating control device of this kind.

Industrially manufactured products are often thermally treated using heaters. Even slight variations in the heating process may have an extremely adverse effect on product quality. In order to increase the quality of a heat-treated product, it is important to be able to focus the required energy very precisely in time and space. This is achieved using special open- and/or closed-loop heating controllers which ensure highly precise control of heating elements. Frequently used as heating elements are resistive loads in the form of radiant heaters, in particular infrared heaters.

Blow molding plants, for example, usually have radiant heater panels for heating preforms. The radiant heaters (infrared heaters) are supplied electrically via a switching element connected into the power supply, controlled in an open-/closed-loop manner and monitored in respect of their power output by an open- and/or closed-loop heating control device.

For this purpose the open- and/or closed-loop heating control device frequently receives setpoint values for the heat output of the connected heating elements from a higher-order open- and/or closed-loop control device, e.g. a programmable logic controller (PLC), via an open field bus. The setpoint values can be provided, for example, in the form of absolute setpoint values, of setpoint values relating to a maximum power or of setpoint values relating to a rated power. The power can relate, for example, to a heat output to be delivered or an electric power to be drawn by heating elements. Control signals for the switching elements are then derived from these setpoint values in the open- and/or closed-loop heating control device using a predefined open- and/or closed-loop control algorithm. However, the setpoint values may also be already available in the form of pulse packets or percentages of half cycles per unit time (e.g. per second) from which control signals for the switching elements can then be derived directly. The control signals are then used to control in an open- or closed-loop manner the switching state of the switching elements and therefore the heat outputs of the heating elements. For simplification and better understanding, all these setpoint values will be referred to as "setpoint values for a heat output" in the following description.

The triggering of the switching elements and therefore the open- or closed-loop control of the switching state or more specifically of the heat output can take place, for example, using phase control or half cycle control using zero power switching elements. Switching elements such as semiconductors (e.g. solid state relays), for example, can be used for this purpose.

Known open- and/or closed-loop heating control devices of this kind usually have an electric output power of approx. 0.5 to 5 kW (for a supply voltage of 230 Vdc) per heating element and a max. total electric output power of 500 kW.

In a plant, a plurality of such open- and/or closed-loop heating control devices are usually supplied (mainly together with other plant equipment) from a common plant power supply system. Because of their electric power requirement, the open- and/or closed-loop heating control devices sometimes place a heavy load on the power system.

In order to optimize the power supply system in respect of its load, it is necessary to know an instantaneous power draw of the open- and/or closed-loop heating control devices or more specifically of the heating elements controlled by them. For this purpose it is already known to explicitly determine the electric power in the open- and/or closed-loop heating control devices on the basis of measured variables (current through the heating elements, voltage across the heating elements), either separately for each heating element (or rather each heating channel) or altogether for each open- and/or closed-loop heating control device. The disadvantage of this is that a complex and therefore costly measuring device is necessary in order to acquire the measured variables.

SUMMARY

One possible object is therefore to provide an inexpensive way of determining the power system load constituted by the open- and/or closed-loop heating control devices.

The inventors propose a method for operating a plant comprising at least one open- and/or closed-loop heating control device for heating elements, values for an energy consumption and/or an instantaneous power draw of the heating elements are determined on the basis of characteristic parameters of the heating elements and on the basis of values of open- and/or closed-loop control variables for the open- and/or closed-loop control of a heat output of the heating elements. With the proposal, no measured values for electric currents are used here It has proved possible, for heating elements, to determine the energy consumption and/or the instantaneous power draw without measuring electric currents, preferably even without measuring any electrical variables at all, by a calculation on the basis of characteristic parameters of the heating elements and on the basis of values of open- and/or closed-loop control variables for the open- and/or closed-loop control of the heat output of the heating elements. The reason for this is that heating elements are substantially purely resistive loads and therefore components of low electrical complexity. Although the accuracy of the calculation is somewhat lower than a measurement, it has surprisingly been found to be adequate for most plants or more precisely applications.

On the other hand, measuring devices for measuring electric currents in particular are very complex and therefore costly. As no measured values for electric currents are used, such a measuring device can be dispensed with. The energy consumption and/or the instantaneous power draw and therefore the power system load can consequently be determined inexpensively. If the energy consumption and/or the instantaneous power draw is determined completely without measuring any electrical variables, no measuring devices at all are required and the associated expense can be completely avoided.

The open- and/or closed-loop control variables can be, for example, heating element setpoint values which are provided e.g. in the form of absolute setpoint values, of setpoint values relating to a maximum power or of setpoint values relating to a rated power. The power can relate, for example, to a heat output to be delivered by heating elements or to an electric power to be drawn by heating elements. However, the setpoint values may also be already available in the form of pulse packets or percentages of half cycles per unit time (e.g. per second) for switching elements for the heating elements.

The energy consumption and/or the power draw can be determined directly in the respective open- and/or closed-loop heating control device and the values determined can then be transmitted e.g. to a higher-level open- and/or closed-loop control device for the heating elements or to a plant energy management system.

The open- and/or closed-loop heating control device is preferably also used for open- and/or closed-loop control of electric fan drives, wherein values for an energy consumption and/or an instantaneous power draw of the fan drives are determined on the basis of characteristic parameters of the fans and on the basis of values of open- and/or closed-loop control variables for the open- and/or closed-loop control of the fan drives without using measured values for electric currents. This is mainly possible if these are simple fan drives of low electrical complexity (e.g. single phase supplied fan drives). For determining the power system load, the energy consumption and/or the power draw of the fans can therefore also be taken into account, wherein this can also be determined at least without measuring electric currents, preferably without measuring any electrical variables at all, by a calculation. Taking the energy consumption or power draw of the fans into account is particularly important in plants in which the energy consumption and/or the power draw of the fans are not negligible compared to those of the heating elements.

The characteristic parameters advantageously include one or more of the following items of information concerning the heating elements, preferably also concerning the fan drives: rated power, rated current, rated voltage.

On the basis of information concerning the type of heating element, preferably also of the type of fan drive, and of the rated power, rated current and/or rated voltage assigned to this type, open- and/or closed-loop control variables such as e.g. an absolute setpoint value, a setpoint value in the form of a percentage setpoint value relating to a maximum power, a percentage of half cycles per unit time (e.g. a second) or a number of pulse packets per unit time (e.g. a second) can be very simply used to deduce the currents through and the voltages across a heating element, preferably also a fan drive, and therefore to determine the energy consumption or the instantaneous power draw. Nonlinearities in the current/voltage characteristics of the heating elements can be taken into account by characteristics which describe the relationship between the power drawn and the respective setpoint value.

According to another advantageous embodiment, voltages across the heating elements or a common supply voltage for the heating elements can be measured and the measured voltage values used to improve the accuracy of the determined values of the energy consumption and/or of the instantaneous power draw. Measuring devices purely for voltage measurement are not very complex and are often already incorporated into open- and/or closed-loop control devices, as they are used to measure a common supply voltage for the heating elements and therefore compensate voltage fluctuations for the open- and/or closed-loop control of the heat output of the heating elements. It has been found that by taking voltage measurements into account instead of calculated or estimated voltage values, the accuracy of the determination of the energy consumption and/or of the instantaneous power draw can be improved with little cost/complexity.

According to a particularly advantageous embodiment, the heat outputs of the heating elements, preferably also outputs of the fan drives, are controlled in an open- and/or closed-loop manner on the basis of the determined energy consumption and/or of the determined instantaneous power draw. This enables the power system load and the operation of the plant to be optimized on the basis of a wide variety of criteria. The open- and/or closed-loop control can be provided e.g. by a higher-order open- or closed-loop control device or an energy management system.

According to a particularly advantageous embodiment, the heat outputs of the heating elements, preferably also the output powers of the fan drives, are controlled in an open- and/or closed-loop manner to meet one or more of the following objectives:

- limiting of peak currents in the plant to a limit value,
- limiting or minimizing the total electric power drawn and/or the total electric energy consumption in the plant,
- maximizing the useful life of the heating elements, preferably also of the fan drives,
- limiting of temperatures in the plant, particularly in switchgear or control cabinets.

According to another advantageous embodiment, the energy consumption and/or the instantaneous power draw of the heating elements is determined over a longer time (e.g. an operating cycle or a working day) and the plant optimized by analyzing the time characteristic. For example, an average power draw over time is determined, compared with a rated output power of the heating elements and if the rated output power is exceeded (undershot) by a predefined limit value in each case, the heating elements can be replaced by heating elements having a higher (lower) rating. This provides a simple way of detecting an underrating (overrating) of heating elements so that they can be replaced by more suitable heating elements.

The inventors also propose an open- and/or closed-loop heating control device for open- and/or closed-loop control of a heat output of heating elements comprises:

- a memory in which characteristic parameters for the heating elements, preferably also for fan drives, are stored,
- a calculation unit which is designed to determine values for an energy consumption and/or an instantaneous power draw of the heating elements, preferably also of the fan drives, on the basis of the characteristic parameters and on the basis of values of open- and/or closed-loop control variables for the open- and/or closed-loop control of a heat output of the heating elements, preferably also of an output power of the fan drives, without using measured values of electric current,
- a communication interface for transmitting the determined energy consumption and/or instantaneous power draw to a higher-level device.

The determined energy consumption and/or instantaneous power draw can then be communicated/reported e.g. to a higher-level open- and/or closed-loop control device or to a higher-level energy management system.

The characteristic parameters preferably comprise one or more of the following items of information concerning the heating elements, preferably also concerning the fan drives: type, rated output, rated current, rated voltage.

According to an advantageous embodiment, the open- and/or closed-loop heating control device is designed to interrogate the characteristic parameters during configuration or start-up and store them in a memory.

The open- and/or closed-loop heating control device is advantageously connected to a voltage measuring device for measuring voltages across the heating elements or a common supply voltage of the heating elements, preferably also for measuring voltages across the fan drives or a common supply voltage of the fan drives, and is designed to use the voltage measurements to improve the accuracy of the determined values of the energy consumption and/or instantaneous power draws.

The inventors further propose a plant that comprises:

- at least one open- and/or closed-loop heating control device as explained above,
- one or more heating elements connected to the open- and/or closed-loop heating control device, preferably also one or more thereto connected fan drives, and
- a higher-level device, in particular a higher-level open- and/or closed-loop control device for the at least one open- and/or closed-loop heating control device or a plant energy management system,
- wherein the at least one open- and/or closed-loop heating control device is connected via its communication interface to the higher-level device in order to transmit the determined energy consumption and/or the instantaneous power draw.

The higher-level device is preferably designed to control the heat outputs of the heating elements, preferably also of the fan drives, in an open- and/or closed-loop manner on the basis of the determined energy consumption and/or of the determined power draws.

According to another advantageous embodiment, the higher-level device is designed to control the heat outputs of the heating elements, preferably also the output power of the fan drives, in an open- and/or closed-loop manner to achieve one or more of the following objectives:

- limiting of peak currents in the plant to a limit value,
- limiting or minimizing the total electric power drawn and/or the total electric energy consumption in the plant,
- maximizing the useful life of the heating elements, preferably also of the fan drives,
- limiting of temperatures in the plant, particularly in switchgear or control cabinets.

According to another advantageous embodiment, the higher-level open- and/or closed-loop control device is designed to determine the energy consumption and/or the instantaneous power draw of the heating elements, preferably also of the fan drives, over a longer time, to analyze the time characteristic and to issue recommendations for optimizing the plant based on this analysis.

BRIEF DESCRIPTION OF THE DRAWINGS

These and other objects and advantages of the present invention will become more apparent and more readily appreciated from the following description of the preferred embodiments, taken in conjunction with the accompanying drawings of which:

A plant 1 shown in the FIGURE comprises a plurality of open- and/or closed-loop heating control devices 2, 3, 4, a higher-level open- and/or closed-loop control device 5 for the open- and/or closed-loop heating control devices 2, 3, 4, other components of which only a single component 6 is shown for the sake of simplicity, and optionally an energy management system 7, wherein all these components are connected to a communication system 20 via which they can communicate with one another. The communication system 20 is preferably an open industrial communication system such as e.g. PROFIBUS or PROFINET.

DETAILED DESCRIPTION OF THE PREFERRED EMBODIMENT

Reference will now be made in detail to the preferred embodiments of the present invention, examples of which are illustrated in the accompanying drawings, wherein like reference numerals refer to like elements throughout.

For this purpose, each of the open- and/or closed-loop heating control devices 2, 3, 4 has a communication interface 8 and a communication unit 9. In addition, each of the open- and/or closed-loop heating control devices 2, 3, 4 has a power input 10 and a plurality of (e.g. nine) power outputs 11. In addition, the units 2, 3, 4 can also have (not shown) other communication interfaces and/or power supply interfaces for the internal power supply of the units 2, 3, 4.

A heating element 12, in particular a radiant heater, or alternatively a fan drive 13 (see by way of example the open- and/or closed-loop heating control devices 3 and 4), is electrically connectable/connected to each of the power outputs 11.

All the power inputs 10 as well as the other plant components 6 are electrically connected to a plant's internal power supply system 14 (e.g. having rated voltage of 400 Vac) for supplying power for the heating elements 12 or the fan drive 13 as the case may be. The power supply system 14 is in turn supplied from a power grid 21 of an energy provider.

Each of the open- and/or closed-loop heating control devices 2, 3, 4 has a power distribution device 15 comprising circuit protection elements (not shown) which is electrically connected on the input side to the power input 10 and on the output side to the power outputs 11 via a branch 16 in each case in order to supply them with electric power from the power supply system 14. A switching element 17 is connected into each of the branches 16. In the case of a connected heating element 12, a semiconductor switch (e.g. a so-called solid state relay) is preferably used as a switching element 17, and in the case of a connected fan drive 13 an electromechanical contactor is alternatively used as a switching element 17.

The switching elements 17 are preferably incorporated in the open- and/or closed-loop heating control devices 2, 3, 4, i.e. enclosed by their housing, but they can also be separate switching elements (i.e. not incorporated in the housing).

Each of the open- and/or closed-loop heating control devices 2, 3, 4 also has an open- and/or closed-loop control unit 18.

The open- and/or closed-loop control unit 18 is designed to control in an open- and/or closed loop manner the switching state of the switching elements 17 as a function of control commands (e.g. connect commands, disconnect commands) and of setpoint values for the heat output.

The setpoint values can be provided e.g. in the form of absolute setpoint values or of setpoint values relating to a maximum power. The power can related e.g. to a heat output to be delivered by heating elements or an electric power to be drawn by heating elements. Control signals for the switching elements 17 are then derived from these setpoint values in the open- and/or closed-loop heating control device 2, 3, 4 using a predefined open- and/or closed-loop control algorithm. However, the setpoint values can also be already available in the form of pulse packets or percentages of half cycles per unit time (e.g. per second) from which control signals for the switching elements can be derived directly in the open- and/or closed-loop control unit 18. The switching states of the switching elements 17 and therefore the heat outputs of the heating elements 12 are then controlled in an open- or closed-loop manner via the control signals.

The control of the switching elements 17 and therefore the open- or closed-loop control of the switching state or rather the heat output can then take place using phase control or half cycle control.

The communication unit 9 is designed to receive, via the communication interface 8, commands for the respective unit 2, 3, 4 (e.g. commands to connect/disconnect the heating elements 12 to/from the power supply system 14) and setpoint values for the heat output and transmit them to the open- and/or closed-loop control unit 18.

Correspondingly, in the case of the open- and/or closed-loop heating control unit 3, the open- and/or closed-loop control unit 18 is designed to control, in an open- and/or closed-loop manner, the switching state of the switching element 17 for the fan drive 13 as a function of control commands (e.g. commands to connect/disconnect the fan drive 13 to/from the power supply system 14) and also optionally of setpoint values for the drive power of the fan drive 13.

In the FIGURE, the open- and/or closed-loop heating control devices 2, 3, 4 are shown in an embodiment as compact units operating independently of one another, each having a separate housing. However, the open- and/or closed-loop heating control devices 2, 3, 4 can also be of modular design and thus in turn include a plurality of modules, such as e.g. a communication and control module and a plurality of power modules of substantially similar design to the open- and/or closed-loop heating control devices 2, 3, 4. The communication and control module here serves as an interface to the communication system 20 and controls the power modules via another communication system which can also be a proprietary communications system.

From the higher-order open- and/or closed-loop control device 5, the open- and/or closed-loop heating control devices 2, 3, 4 receive via the communication system 20 connect and disconnect commands for connecting/disconnecting the heating elements 12 or fan 13 to/from the power supply system 14 and the setpoint values for the heat output of the heating elements 12, optionally also for the output power of the fan drive 13.

The open- and/or closed-loop heating control devices 2, 3, 4 additionally have a memory 25 in which characteristic parameters for the heating elements 12 and for the fan drive 13—if present—are stored. The characteristic parameters comprise one or more of the following items of information concerning the heating elements or fans drives as the case may be: type, rated power, rated current, rated voltage.

For this purpose the open- and/or closed-loop heating control devices 2, 3, 4 are designed to interrogate the characteristic parameters at configuration or startup and store them in the memory 25.

The open- and/or closed-loop control unit 18 comprises a calculation unit 19 which is designed to determine values for an energy consumption and/or an instantaneous power draw of the heating elements 12 and of the fan drive 13—if present—on the basis of the characteristic parameters and on the basis of values of open- and/or closed-loop control variables for the open- and/or closed-loop control of the heat output of the heating elements 12 and of the fan drive 13—if present—without using measured values of electric currents. The values are preferably determined without using measured values of any electrical variables, i.e. solely on the basis of the characteristic parameters and on the basis of values of open- and/or closed-loop control variables.

The accuracy of the determined values of the energy consumption and/or of the power draw can optionally be improved with relatively low cost/complexity by connecting the open- and/or closed-loop control unit 18 to a voltage measuring device 26 for measuring voltages across the heating elements 12—and across any fan drive 13 present—and for measuring the voltage of the power supply system 14 and designing it to use the voltage measurements to improve the accuracy of the determined values of the energy consumption and/or instantaneous power draws.

The communication unit 9 and the communication interface 8 are then used to transmit the determined energy consumption and/or the determined power draw to the higher-level open- and/or closed-loop control device 5 and/or to any energy management system 7 present.

The higher-level open- and/or closed-loop control device 5 and/or the energy management system 7 or both in conjunction with one another is (are) designed to control in an open- and/or closed-loop manner the heat outputs of the heating elements 12, preferably also the output power of the fan drives 13, on the basis of the determined energy consumption and/or of the determined power draws, namely preferably to achieve one or more of the following objectives:

- limiting of peak currents in the power supply system 14 of the plant 1 to a limit value,
- limiting or minimizing the total electric power drawn and/or the total electric energy consumption in the power supply system 14 of the plant 1,
- maximizing the useful life of the heating elements 12, preferably also of the fan drives 13,
- limiting of temperatures in the plant 1, particularly in switchgear or control cabinets.

The higher-level open- and/or closed-loop control device 5, or any energy management system 7 present, is also designed to determine the power draws of the heating elements 12 over a longer time (e.g. an operating cycle or a working day) and to issue recommendations for optimizing the plant 1 by analyzing the time characteristic. For example, an average power draw over time can be determined, compared with a rated power output of the heating elements, and if the rated output is exceeded and/or undershot by a predefined limit value in each case, a signal can be generated.

During operation of the plant 1, on the basis of the characteristic parameters of the heating elements 12, preferably also of the fan drives 13, and also on the basis of values of open- and/or closed-loop control variables for the open- and/or closed-loop control of the heat output of the heating elements 12, preferably also of the output power of the fan drives 13, the energy consumption and/or power draw thereof is determined in each of the open- and/or closed-loop heating control devices 2, 3, 4 by the respective calculation unit 19 and transmitted via the communication system 20 to the higher-level open- and/or closed-loop control device 5, also to any energy management system 7 present.

For this purpose, a rated output power Pn of each heating element 12 with rated voltage applied (e.g. 230 Vac) as well as a type factor T(S) depending on the type of heating element 12 and on the setpoint value for the heat output (as % of the rated output power Pn) are stored in the memory 25. The type factor takes into account the heating-element-type dependent nonlinearity between the setpoint value and the actual energy consumption or the electric power actually drawn. The type factor (TS) can be provided, for example, in the form of a family of characteristics for different setpoint values S.

The electric power draw for each heating element 12 is then:

$$P=Pn*S/100\%*T(S)$$

By the voltage measuring device 26, the voltage dropped across the heating elements 12, preferably also across the fan drives 13, or the voltage of the common power supply 14 can be measured and the measured voltage values can be used to improve the accuracy of the determined values of the energy consumption and/or power draw.

Taking into account a thereby measured voltage U, the electric power draw per heating element 12 is then:

$$P=Pn*S/100\%*T(S)*(U/Un)^2$$

where Un is the rated voltage of the heating element 12.

The heat outputs of the heating elements 12, preferably also the fan drives 13, are then controlled in an open- and/or closed-loop manner by the higher-level open- and/or closed-loop control device 5 on the basis of the received energy consumption and/or power draw. This can also take place in conjunction with the energy management system 7 which transmits connect or disconnect commands for the heating elements 12, preferably also for the fan drives 13, or limit values for the power drawn or the energy consumption via the communication system 20 to the higher-level open- and/or closed-loop control device 5. The latter then generates the control commands and setpoint values for the heat output of the heating elements 12, preferably also for the output power of the fan drives 13, depending on values received from the energy management system 7.

In the higher-level open- and/or closed-loop control device 5, in the energy management system 7 or by the interaction thereof, open- and/or closed-loop control can in principle be exercised to meet one or more of the following objectives:

- limiting of peak currents in the power supply system 14 of the plant 1 to a limit value,
- limiting or minimizing the total electric power drawn and/or the total electric energy consumption in the power supply system 14 of the plant 1,
- maximizing the useful life of the heating elements 12, preferably also of the fan drives 13,
- limiting of temperatures in the plant 1, particularly in switchgear or control cabinets.

In the higher-level open- and/or closed-loop control device 5, in the energy management system 7 or by the interaction thereof, the energy consumption and/or the power draw of the heating elements 12, preferably also of the fan drives, can be determined over a longer time, the time characteristic analyzed and recommendations for plant optimization issued.

For this purpose, an average power draw over time can be determined, compared with a rated output of the heating elements 12, and if the rated output is exceeded (undershot) by a predefine limit value, the heating elements 12 are replaced by heating elements having a higher (lower) rating. This provides a simple way of detecting an overrating (underrating) of heating elements, enabling them to be replaced by more suitable heating elements. A corresponding procedure is naturally also possible in respect of the fan drives 13.

The energy consumption and/or the power draw is therefore determined without measuring electric currents, preferably without measuring any electrical variables, by a calculation based on characteristic parameters of the heating elements 12 (preferably also of the fan drives 13) and on values of open- and/or closed-loop control variables for the open- and/or closed-loop control of the heat output of the heating elements 12 (preferably also of the output of the fan drives 13). Consequently, this requires little or nothing at all in the way of complex and costly measuring equipment.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in Superguide v. DIRECTV, 69 USPQ2d 1865 (Fed. Cir. 2004).

The invention claimed is:

1. A method for operating a plant having a control device that is connected to one or more heating elements, the method comprising: obtaining characteristic parameters of the one or more heating elements and obtaining values of control variables for control of a heat output of the one or more heating elements, the control of the heat output of the one or more heating elements being at least one of an open-loop control and a closed-loop control; and determining values for at least one of an energy consumption and an instantaneous power draw of the one or more heating elements based on the characteristic parameters of the one or more heating elements and the values of the control variables which are heating element setpoint values in the form of absolute setpoint values, in the form of percentage setpoint values relating to a maximum power or in the form of percentage setpoint values relating to a rated power for the control of the heat output of the one or more heating elements, without using measured values for electric currents of the one or more heating elements, controlling the heat output of the one or more heating elements in an open- and/or closed-loop manner based on the determined values for the at least one of the energy consumption and the instantaneous power draw of the one or more heating elements, wherein the values for the at least one of the energy consumption and the instantaneous power draw of the one or more heating elements are determined over a predetermined period of time and the plant is optimized by analyzing a time characteristic.

2. The method as claimed in claim 1, wherein the control device is used for control of one or more electric fan drives, and wherein the method further comprises:

- obtaining characteristic parameters of the one or more fan drives and obtaining values of control variables for the control of the one or more fan drives, the control of the one or more fan drives being at least one of an open-loop control and a closed-loop control; and
- determining at least one of an energy consumption and an instantaneous power draw of the one or more fan drives based on the characteristic parameters of the one or more fan drives and the values of the control variables for the control of the one or more fan drives, without using measured values for electric currents of the one or more fan drives.

3. The method as claimed in claim 1, wherein the characteristic parameters include at least one of a device type, a rated output, a rated current, and a rated voltage for the one or more heating elements.

4. The method as claimed in claim 1, further comprising: measuring voltages across the one or more heating elements or measuring a common supply voltage for the one or more heating elements; and using the measured voltages across the one or more heating elements or the measured common supply voltage when determining the values for the at least one of the energy consumption and the instantaneous power draw of the one or more heating elements.

5. The method as claimed in claim 1, wherein controlling the heat output of the one or more heating elements includes: limiting peak currents in the plant to a limit value, limiting or minimizing a total electric power drawn and/or a total electric energy consumption in the plant, maximizing a useful life of the one or more heating elements, and limiting temperatures in the plant.

6. The method as claimed in claim 2, wherein the characteristic parameters of the of the one or more fan drives include at least one of a device type, a rated output, a rated current, and a rated voltage for the one or more fan drives.

7. The method as claimed in claim 2, further comprising: controlling output power of the one or more fan drives in an open- and/or closed-loop manner based on the determined values for the at least one of the energy consumption and the instantaneous power draw of the one or more fan drives.

8. A control device to control of a heat output of one or more heating elements, the control device comprising:

a memory that stores characteristic parameters for the one or more heating elements;

a calculation unit configured to determine values for at least one of an energy consumption and an instantaneous power draw of the one or more heating elements based on the characteristic parameters for the one or more heating elements and based on values of control variables which are heating element setpoint values in the form of absolute setpoint values, in the form of percentage setpoint values relating to a maximum power or in the form of percentage setpoint values relating to a rated power for the control of the heat output of the one or more heating elements, without using measured values of electric currents of the one or more heating elements, the control of the heat output of the one or more heating elements being at least one of an open-loop control and a closed-loop control; and a communication interface configured to transmit the determined values for the at least one of the energy consumption and the instantaneous power draw of the one or more heating elements to a higher-level open- and/or closed-loop control device, wherein the higher-level open- and/or closed-loop control device is configured to determine the values for the at least one of the energy consumption and the instantaneous power draw of the one or more heating elements over a predetermined period of time, to analyze a time characteristic and to issue recommendations for optimization of the plant based on the analysis.

9. The control device as claimed in claim 8, wherein the characteristic parameters includes at least one of a device type, a rated output, a rated current, and a rated voltage for the one or more heating elements.

10. The control device as claimed in claim 8, wherein the control device is configured to interrogate the characteristic parameters of the one or more heating elements during configuration or start-up and configured to store the characteristic parameters of the one or more heating elements in the memory.

11. The control device as claimed in claim 8, wherein the control device is connected to a voltage measuring device for measuring voltages across the one or more heating elements or measuring a common supply voltage of the one or more heating elements, and wherein the calculation unit uses the measured voltages across the one or more heating elements or the measured common supply voltage when determining the values for the at least one of the energy consumption and the instantaneous power draw of the one or more heating elements.

12. A plant, comprising:

at least one control device as claimed in claim 8; and a higher-level device that is one of a higher-level open- and/or closed-loop control device for the at least one control device and an energy management system of the plant, wherein the at least one control device is connected to the higher-level device to transmit the determined values for the at least one of the energy consumption and instantaneous power draw of the one or more heating elements via the communication interface.

13. The plant as claimed in claim 12, wherein the higher-level device is configured to control, in an open- and/or closed-loop manner, the heat output of the one or more heating elements based on the determined values for the at least one of the energy consumption and the determined instantaneous power draw of the one or more heating elements.

14. The plant as claimed in claim 13, wherein the higher-level device is configured to control the heat output of the one or more heating elements by limiting peak currents in the plant to a limit value, limiting or minimizing a total electric power drawn and/or a total electric energy consumption in the plant, maximizing a useful life of the one or more heating elements, and limiting temperatures in the plant.

15. The control device as claimed in claim 8, wherein the memory stores characteristic parameters for one or more fan drives connected to the control device, the calculation unit is configured to determine values for at least one of an energy consumption and an instantaneous power draw of the one or more fan drives based on the characteristic parameters for the one or more fan drives and based on values of control variables for control of the one or more fan drives, without using measured values of electric currents of the one or more fan drives, the control of the one or more fan drives being at least one of an open-loop control and a closed-loop control, and the communication interface is configured to transmit the determined values for the at least one of the energy consumption and the instantaneous power draw of the one or more fan drives to the higher-level device.

16. The control device as claimed in claim 15, wherein the characteristic parameters of the of the one or more fan drives include at least one of a device type, a rated output, a rated current, and a rated voltage for the one or more fan drives.

17. A plant, comprising:

at least one control device as claimed in claim 15; and a higher-level device that is one of a higher-level open- and/or closed-loop control device for the at least one control device and an energy management system of the plant, wherein the at least one control device is connected to the higher-level device to transmit the determined values for the at least one of the energy consumption and instantaneous power draw of the one or more heating elements via the communication interface and to transmit the determined values for the at least one of the energy consumption and instantaneous power draw of the one or more fan drives via the communication interface.

* * * * *